United States Patent [19]

Creamer et al.

[11] 3,946,458

[45] Mar. 30, 1976

[54] APPARATUS FOR COLLECTING SURFACE LIQUIDS

[76] Inventors: Marven Creamer; Adelene B. Creamer, both of 137 Palmer Ave., Mountain View, Calif. 94040

[22] Filed. Jan. 17, 1974

[21] Appl. No.: 434,452

Related U.S. Application Data

[60] Continuation of Ser. No. 872,790, Aug. 22, 1969, abandoned, which is a division of Ser. No. 820,175, April 29, 1969, Pat. No. 3,562,846.

[52] U.S. Cl. ..... 15/339

[51] Int. Cl.[2] ..... A47L 7/00

[58] Field of Search ..... 15/320, 321, 339, 353, 15/352

[56] References Cited

UNITED STATES PATENTS

| | | | |
|---|---|---|---|
| 961,816 | 6/1910 | Squier | 15/321 |
| 1,762,142 | 6/1930 | Breton | 15/320 |
| 1,940,244 | 12/1933 | Carlstedt | 15/327 E |
| 2,033,833 | 3/1936 | Kent | 15/339 X |
| 2,763,886 | 9/1956 | Brown, Jr. et al | 15/353 X |

*Primary Examiner*—Stanley N. Gilreath
*Assistant Examiner*—C. K. Moore

[57] ABSTRACT

Apparatus for drawing liquid by suction from a surface and into a reservoir including intake and exhaust conduits communicating with the reservoir. The intake conduit has an inner end which is shaped to provide a continuous change in the path of flow of the liquid flowing therethrough to thereby avoid impact of the liquid with adjacent structure and thereby minimize aeration of the liquid. The apparatus can be in the form of an attachment for a conventional vacuum cleaner or can be self-contained. It is constructed to provide assurance that the suction force produced is such as to prevent liquid from passing out of the reservoir through the exhaust conduit.

1 Claim, 12 Drawing Figures

FIG. 1
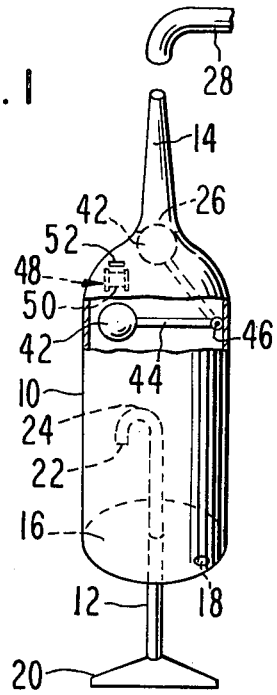
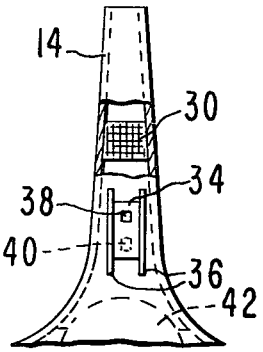
FIG. 1a
FIG. 1b
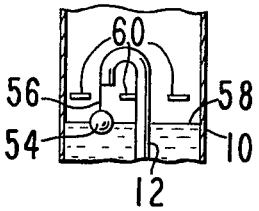
FIG. 2
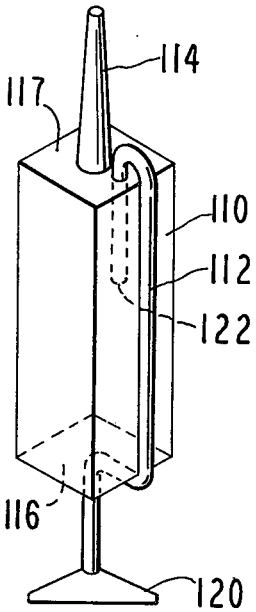
FIG. 4
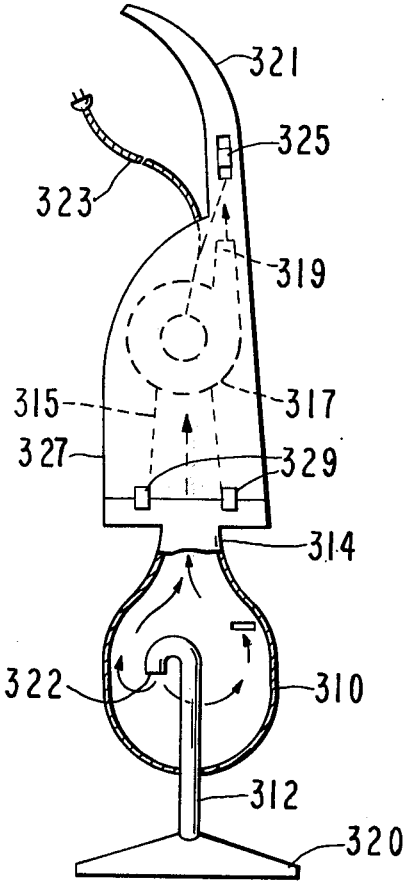
FIG. 3
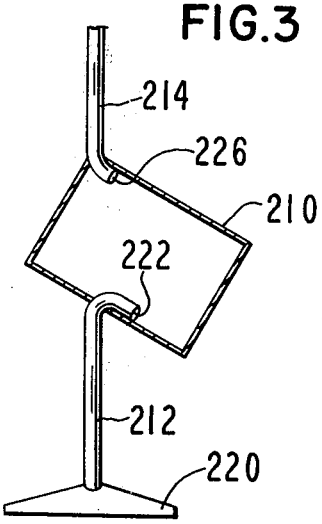
INVENTORS
MARVEN CREAMER
ADELENE B. CREAMER
ATTORNEYS FIG. 5
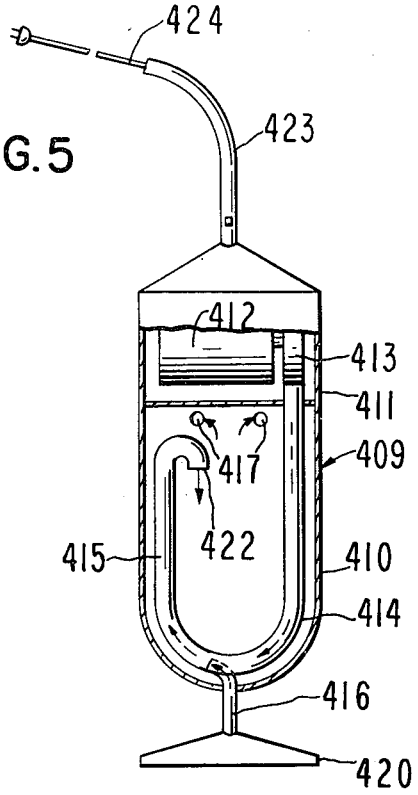
FIG. 6
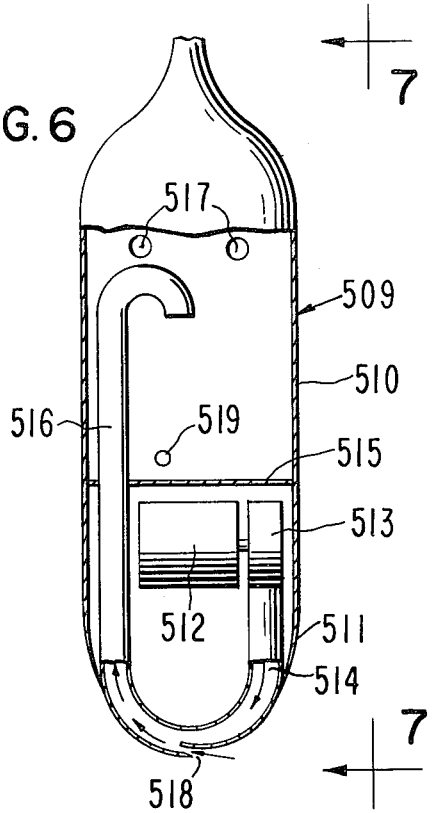
FIG. 7
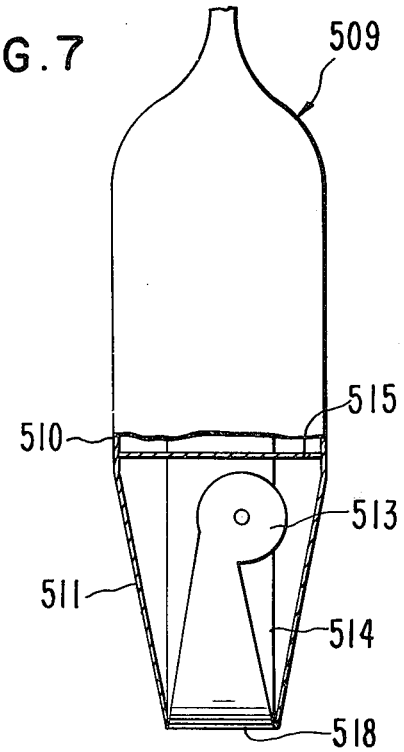
FIG. 8
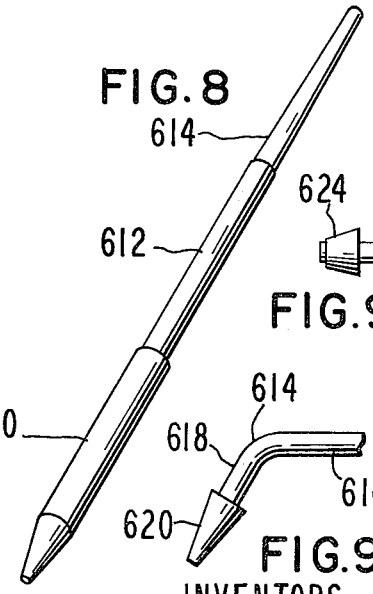
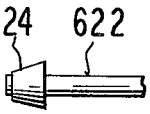
FIG. 9a
FIG. 9
INVENTORS
MARVEN CREAMER
ADELENE B. CREAMER
ATTORNEYS

APPARATUS FOR COLLECTING SURFACE LIQUIDS

This is a continuation of application Ser. No. 872,790, filed Aug. 22, 1969, now abandoned, the latter application being a division of application Ser. No. 820,175, filed Apr. 29, 1969, now U.S. Pat. No. 3,562,846, issued Feb. 16, 1971.

This invention relates to improvements in vacuum pick-up devices and, more particularly, to an improved apparatus for picking up liquids by suction from a floor or other supporting surface.

The present invention is directed to an improved liquid collecting device which operates by sucking liquids up from a floor or other surface with the use of a fluid flow of relatively low velocity to create the requisite suction force. This force is of a value to cause the liquid to be effectively collected without causing aeration of the liquid. Thus, the liquid can be trapped and be effectively prevented from reaching and damaging a vacuum device defining the source of the suction force. The apparatus includes a reservoir having an intake conduit and an exhaust conduit, with the conduits being configured and disposed relative to each other such that the liquid entering the reservoir through the intake conduit will be trapped and retained in the reservoir, yet the exhaust conduit allows the outward flow of fluid used to create the suction force at the inlet end of the intake conduit.

Another feature of the invention is the way in which the intake conduit is shaped adjacent to its outlet end to provide a liquid flow path which gradually changes in direction to assure that the liquid is effectively directed into the reservoir without substantial impact with adjacent structure to thereby minimize or substantially eliminate aeration of the liquid which ordinarily might cause structural damage to a vacuum device defining the source of the suction force for the intake conduit. To this end, the inner end portion of the conduit is provided with a converted J-shaped configuration which effectively changes the direction of flow of the liquid by about 180° with the open inner end of the end portion facing away from the exhaust conduit. Thus, liquid is effectively prevented from being directed into the exhaust conduit and is directed toward the bottom of the reservoir.

The apparatus can be used with conventional vacuum cleaners as an attachment thereto or it can be self-contained, i.e., have its own suction source. When used as an attachment, the apparatus is provided with vent means which is adjustable to vary the suction force created within the intake conduit by an external vacuum source. In this way, assurance is had that the suction force will not be so great as to cause the liquid to leave the exhaust conduit and enter the vacuum source so as to damage the same. In addition, means is provided to block off the exhaust conduit if the suction force is too great so that the operator of the apparatus will know that adjustment of the vent means is required to achieve proper operation of the apparatus. Such adjustment is sufficient to lower the suction force to a value below which liquid will be caused to flow into the exhaust conduit. Means may also be provided to indicate when the proper adjustment and thereby the optimum value of suction force has been reached. This force will be essentially constant for a given vacuum source; thus, if the attachment is used with the same vacuum source at all times, the proper vent position need be determined only once.

If the apparatus is a self-contained unit, the vacuum source will create a known suction force so that the intake and exhaust conduits can be designed and constructed to provide the proper suction force sufficient to prevent the liquid from passing into the exhaust conduit. Thus, the vent means used with the apparatus when the same is in the form of an attachment is not needed.

A further feature of the apparatus is the means coupled with the intake conduit to prevent overfilling of the reservoir beyond a safe liquid capacity. Thus, if the liquid volume becomes too great in the reservoir, the intake conduit is closed off from the source of suction to thereby require emptying of the reservoir before additional liquid can be drawn thereinto. A suitable drain can be provided on the reservoir to dispose of the liquid therein.

Other features of the invention include a filter which can be put in the exhaust conduit to trap liquid particles as they enter the exhaust conduit itself, and a telescopic wand-like conduit which can be used as the exhaust conduit with the reservoir or can be used with a conventional vacuum cleaner generally to allow the suction force to be applied in hard-to-reach places, such as along beamed ceilings. The conduit is formed from a number of relatively telescoped, tubular sections, at least one of which may have a tapered outer surface so that it can provide a universal fit for hose connectors of different internal diameters, and standard vacuum tools.

With the foregoing features, the present invention provides a lightweight, safe device for use in picking up water and other liquids from a floor or other supporting surface wherein the device is simple in construction and economical to use and if, in the form of an attachment, can be used with a standard household vacuum cleaner by any operator. Generally, a housewife is not so much concerned with the rate at which liquid is picked up from the floor as much as with the fact that the liquid itself is taken up with a minimum expenditure of labor. The present invention meets this need by providing a means to accomplish liquid pick-up by the use of relatively low fluid velocities to avoid causing structural damage to a vacuum source itself but large enough to assure proper liquid pick-up.

The primary object of this invention is to provide an improved liquid pick-up device of the type using a suction device wherein the liquid pick-up is accomplished at a relatively low fluid velocity to prevent sucking of liquid into the suction device to thereby permit it to be safely used with a household vacuum cleaner as an attachment thereto.

Another object of this invention is to provide an apparatus of the type described which can be provided in the form of an attachment for use with a standard vacuum cleaner or can be self-contained to incorporate its own suction device and, in either form, the invention is constructed to provide for the optimum suction force at the liquid inlet thereof to efficiently draw liquids by suction into a reservoir forming a part of the apparatus.

Another object of this invention is to provide an apparatus of the aforesaid character which is simple and rugged in construction, economical to produce and operate, and can be used in substantially the same manner as a conventional vacuum cleaner.

A further feature of the present invention is to provide a wand-like conduit for use with a conventional vacuum cleaner wherein the conduit is provided with a number of relatively telescoped sections which, when extended end-to-end, allow penetration into hard-to-reach areas such as in corners of rafters and along ceiling beams or the like to thereby provide more versatility for a vacuum cleaner than is capable with conventional equipment.

Other objects of this invention will become apparent as the following specification progresses, reference being had to the accompanying drawings for illustrations of a number of embodiments of the invention.

In the drawings:

FIG. 1 is a side elevational view, partly in section, of one form of the invention when used as an attachment for a vacuum cleaner;

FIG. 1*a* is an enlarged, fragmentary, cross-sectional view of the exhaust conduit of FIG. 1;

FIG. 1*b* is a fragmentary, cross-sectional view of the apparatus of FIG. 1, showing the closure means for the intake conduit thereof;

FIG. 2 is a view similar to FIG. 1 but showing a second embodiment of the invention as an attachment;

FIG. 3 is a view similar to FIGS. 1 and 2 but partly in section and showing a third embodiment of the invention as an attachment;

FIG. 4 is a side elevational view, partly in section, of an embodiment of the invention when the latter is in the form of a self-contained unit;

FIG. 5 is another embodiment of a self-contained unit;

FIG. 6 is still a further embodiment of a selfcontained unit;

FIG. 7 is a side elevational view looking along the lines 7—7 of FIG. 6;

FIG. 8 is a perspective view of the wand-like conduit for use with a vacuum cleaner;

FIG. 9 is a modified end section for the conduit of FIG. 8; and

FIG. 9*a* is a view of a tube connecting sleeve.

The first embodiment of the present invention is shown in FIG. 1 and FIG. 1*a* and is comprised of an assembly which includes a tank or reservoir 10, an intake conduit 12 and an exhaust conduit 14. Tank 10 may be of any configuration but, for purposes of illustration, it is cylindrical and is provided with a bottom 16 through which intake conduit 12 extends. A suitable drain 18 is provided to permit liquids in the tank to be removed therefrom at a disposal point.

Conduit 12 has an outer open end for receiving liquids and is shaped so that a fluid pick-up attachment 20 can be releasably connected thereto. The inner end of conduit 12 is curved to present an inverted J-shaped configuration to provide a liquid flow path which progressably changes in direction from the main part of the conduit to the inner open end 22 thereof. To this end, the conduit has a arcuate inner surface 24 which has essentially no discontinuities so that liquid particles flowing upwardly through conduit 12 will progressively be changed in direction as the particles engage the inner surface 24. Finally, the liquid particles will exit from the conduit from open end 22 and be directed downwardly toward the bottom of tank 10 along a path which is substantially reverse to the direction of the incoming path through the major portion of intake conduit 12. The liquid enters the tank along a path extending away from the inlet opening 26 of exhaust conduit 14. This feature provides a means for preventing flow of liquid or aerified liquid to and through exhaust conduit 14 since the arcuate path presented by the inverted J-shaped configuration causes the liquid flow to enter the tank in a direction away from the exhaust conduit yet there is no substantial impact of the liquid against adjacent structure, such as inner surface 24, so as to cause aeration of the liquid.

The embodiment of FIG. 1 is adapted to be used as an attachment with a standard vacuum cleaner (not shown) of the type having a flexible hose 28. Exhaust conduit 14 may have a tapered outer surface as shown in FIG. 1 to permit it to be universally used with hoses of different inside diameters. Thus, a small diameter hose will engage the outer surface of conduit 14 near the outer end of the latter; whereas, a large diameter hose will engage conduit 14 at a location nearer to tank 10.

A filter 30 in the form of a plug can be placed within exhaust conduit 14 to trap liquid particles that may be carried by the exhaust fluid. To this end, this conduit can be formed of two parts if desired, to permit insertion and removal of the filter plug. Such plug can contain fibrous material, absorbent crystals or a combination of both with the filter having a density sufficient to allow air to pass therethrough but to effectively trap liquid particles.

Vent means 32 is provided to vent either tank 10 or exhaust conduit 14 to the atmosphere to thereby permit control of the suction force at the inlet end of intake conduit 12. For purposes of illustration, vent means 32 is on conduit 14 (FIG. 1*a*) and may be of any suitable construction. Again, for purposes of illustration, it includes a shiftable member 34 carried by a pair of spaced guides 36 with member 34 having an opening 38 therein for adjustable alignment with an opening 40 in the sidewall of the conduit. Thus, the position of member 34 can be adjustably set with a greater or lesser amount of opening 38 in alignment with opening 40 to thereby vent the interior of the conduit to the atmosphere by greater or lesser degree. Thus, for a greater degree of venting, the suction force at the inlet end of intake conduit 12 will be relatively small and for a lesser degree of venting, this suction force will be relatively large. With no venting at all, the suction force will be a maximum value.

If the suction force is too great, liquid may be accidentally sucked into the exhaust conduit and then into the vacuum source coupled thereto so as to cause structural damage to it. To prevent this from occurring, a valve member 42 is shiftably carried by an arm 44 pivoted on the inner surface of reservoir 10 by pivot means 46. Valve 42 is normally in the full line position of FIG. 1, out of blocking relationship to exhaust conduit 14 and between conduit 12 and vent means 32, assuming that the suction force is a minimum or, at least, less than the maximum value, i.e., when there is no venting of the tank. If the suction force is too great, the suction at the inlet 26 of exhaust conduit 14 will draw valve member 42 into the dashed line position of FIG. 1 to thereby close inlet 26. Thus, the operator will know that some venting is required and will take steps to adjust member 34 so that suction again is established at the inlet end of intake conduit 12. This will occur when the suction force at opening 26 is such as to cause valve member 42 to return to its full line position or at least shift away from opening 26 so as to unblock the same.

Indicator means 48 can be provided to indicate when the proper value of suction force has been achieved, i.e., when the proper setting of the vent means has been found. Any form of indicator can be used but, for purposes of illustration, a movable strip 50 carried in some suitable manner on the inner surface of tank 10 can be provided so that it is responsive to the fluid flow into exhaust conduit 14. A suitable window 52 can be provided on the tank to view one end of strip 50 when the latter has moved to a position corresponding to the proper value of suction force. Thus, the operator of the apparatus, with valve 44 and indicator means 48, will know when and by how much to adjust the vent means. This feature assures that liquid will be effectively trapped in the reservoir and will be prevented from passing into the exhaust conduit to a location at which it can cause structural damage to the vacuum source itself.

In FIG. 1*a*, a closure 54 is carried by intake conduit 12 in some suitable manner, such as by a flexible connector link 56. Closure 54 operates to move into closing relationship with inner end 22 of conduit 12 when the liquid level within the tank goes above a safe level, such as level 58 denoted by the dashed lines of FIG. 1*a*. In this way, suction force will be removed from the interior of conduit 12 and it will be necessary to empty the tank before the apparatus can again be used. Drain openings 60 can also be provided in the sidewall of tank 10 to guard against overfilling. Liquid will flow through openings 60 and out of the reservoir if the level of the liquid rises above level 58.

In use, the apparatus of FIG. 1 is coupled by hose 28 to a vacuum source and can be provided with a suitable attachment 20 at the inlet end of conduit 12. If the vacuum source has not been used with the apparatus before, the vent means is initially adjusted to provide the proper suction force at the inlet end of conduit 12. This is accomplished by first actuating the vacuum source with the vent means in a full open position and then by moving member 34 so that the vent is progressively closed until liquid pick-up from a floor or surface is accomplished. This can also be achieved by noting the position of strip 50 with respect to window 52. Once the vent means has been set, it will not have to be changed if the same vacuum source is used with the apparatus.

The operator can then grasp hose 28 or conduit 14 and move attachment 20 over the floor or surface containing the liquid and the suction force at the inlet end of conduit 12 will suck up the liquid and cause it to pass into reservoir 10 from conduit 12. The progressive change in the direction of the liquid flow due to the configuration of the inner end of conduit 12 will substantially prevent aeration of the liquid, such as ordinarily occurs when liquid carried by an air flow splashes against an abutment. The liquid will then pass into the tank while the air will again reverse direction and travel upwardly and into and through conduit 14 for exit outwardly therefrom through hose 28 and to the vacuum source. At any time or when it is full, the tank can be emptied by opening valve 18 at a suitable disposal station. Also, closure 54 operates to prevent liquid from overflowing back into conduit 12. The liquid can flow through openings 60 if the liquid level rises above level 58 (FIG. 1a).

Another embodiment of the invention as an attachment is shown in FIG. 2 and includes a tank or reservoir 110 which, for purposes of illustration, is transversely square. Reservoir 110 has a bottom 116 and a top 117 and is provided with an intake conduit 112 and an exhaust conduit 114. Conduit 112 has an irregular shape so that a portion of it extends along the outer surface of bottom 116, a second portion extends along the outer side surface of reservoir 110 and a third portion extends into the reservoir to top 117. The third portion has an inverted J-shaped configuration for the same purpose as that of conduit 12 of FIG. 1. The open inner end 122 of intake conduit 112 is below and faces away from the inlet end of exhaust conduit 114 to thereby cause liquids to be directed immediately downwardly and away from conduit 114. Thus, liquid particles will be projected downwardly toward the bottom of the tank rather than being carried upwardly with the flow of air as the air flow changes direction and flows upwardly toward and into conduit 114. A suitable attachment 120 may be provided on the lower end of intake conduit 112 for engaging the floor or other surface having liquid to be sucked up into the reservoir. A suitable drain (not shown) can be used with the reservoir to permit emptying of the same. Also, the other features of the FIG. 1 embodiment, such as the adjustable vent means, the indicator means, and the valve means can be provided for the embodiment of FIG. 2. Moreover, the outer surface of conduit 114 is tapered for the purpose described above with respect to conduit 14. The embodiment of FIG. 2 is used in essentially the same manner as that of FIG. 1.

A third embodiment of the invention as an attachment is shown in FIG. 3 and includes a tank or reservoir 210 having a pair of opposed sides. An intake conduit 212 extends through one of the sides and an exhaust conduit 214 extends through the opposite side with both conduits communicating with the reservoir. Conduit 212 has an open outlet end 222 which faces away from the open inlet end 226 of conduit 214. Also, conduit 212 has an inverted J-shaped configuration adjacent to its outlet end for the same purpose as that of the embodiments of FIGS. 1 and 2. The embodiment of FIG. 3 will also have all of the additional structural features shown in FIG. 1, namely, the vent means, the valve for closing the inlet end of the exhaust conduit, the indicator means, and the closure for the inner end of the intake conduit 212. Also, the embodiment of FIG. 3 is used in essentially the same way as the embodiments of FIGS. 1 and 2.

The apparatus of this invention can be in the form of a self-contained unit, as shown in FIG. 4, wherein a tank or reservoir 310 is provided with an intake conduit 312 having an attachment 320 on the liquid inlet end thereof. Conduit 312 extends into reservoir 310 and has an inverted J-shaped upper portion terminating in an open outlet end 322, the J-shaped configuration being for the same purpose as that described above with respect to the other embodiments.

Exhaust conduit 314 is essentially the neck of reservoir 310. Thus, opening 322 is facing in the opposite direction from the inlet end of conduit 314 to thereby assure that liquid particles will be prevented from passing into the exhaust conduit and will be directed downwardly into the reservoir.

Conduit 314 is in fluid communication with a duct 315 which communicates with the fluid intake of a suction device, such as a blower 317 having an outlet end 319 communicating with a tubular handle 321 whose outer surface can be tapered as shown in FIG. 4. A variable speed motor (not shown) for operating blower 317 is provided with electrical power by means of a suitable line cord 323. Variable speed switch means 325 is provided on handle 321 and is coupled with the motor to provide controlled operation thereof at different speeds. This variable speed feature allows the embodiment of FIG. 4 to be of the type which can be converted from a liquid pick-up device to a dust or dirt pick-up device. To this end, reservoir 310 is releasably connected by fasteners 329 to the housing 327 which houses duct 315, blower 317 and the motor for actuating the blower. Another attachment, such as a housing containing a dust bag, can be connected to housing 327 by means of fasteners 329 after reservoir 310 has been separated from housing 327. Generally, a greater suction force will be utilized with a dust bag attachment than is used with reservoir 310. Thus, by selection of the proper switch of switch means 325, variations in the suction force can be achieved. This is accomplished by varying the operating speed of the motor coupled to the blower to thereby provide a suction force at the inlet end of intake conduit 312 of greater or lesser value.

The unit of FIG. 4 is used in the same way as the embodiments previously described. The self-contained unit does not need vent means; hence, switch means 325 and the construction of the reservoir and conduits can be such as to provide the proper suction force at the inlet end of the intake conduit 312 for the operating characteristics of a given motor. A suitable drain can be provided to discharge liquid from the reservoir and also suitable closure, similar to closure 54 (FIG. 1a), can be provided with conduit 312 to prevent reverse flow of liquid through this conduit in the event that reservoir 310 is filled beyond a safe level.

Another embodiment of the self-contained unit is shown in FIG. 5 wherein a housing 409 is divided into a reservoir 410 and an upper compartment 411 for containing a motor 412 and a blower 413 which defines means for creating a suction at the inlet end of an intake conduit. The positive air pressure outlet of blower 413 is connected to one end of a U-shaped tube 414 having a side section 415 which terminates in an inverted J-shaped configuration as shown in FIG. 4, such configuration being for the same purpose as that described above for the other embodiments. Section 415 is in communication with a curved tubular section 416, sections 415 and 416 defining an intake conduit whose inlet end exteriorly of housing 409 is coupled to an attachment 420 for engaging a floor having liquids thereon to be sucked up into reservoir 410. The configuration of section 416 is such as to create a suction force therein in response to the forced air flow from blower 413 through tube 414 and into section 415. A pair of openings 417 through reservoir 410 define an exhaust conduit means for air entering the reservoir from intake conduit 408.

The self-contained unit of FIG. 5 will have a constant suction force at inlet end of suction 416 if motor 412 is of the single speed type. Thus, the configuration of various components and the size of the blower are selected to provide the necessary recovery of liquids from the pick-up from the floor so as to prevent the flow of the liquid out of the reservoir through openings 417. A suitable drain plug can be used to empty the reservoir and a suitable closure can be provided on the inner end of section 415 to prevent reverse flow of liquid in the event the reservoir 410 becomes too full. The embodiment of FIG. 5 is used in essentially the same way as the embodiment of FIG. 4.

A further embodiment of a self-contained unit is shown in FIGS. 6 and 7 and includes a housing 509 having an upper compartment 510 defining a tank or reservoir and a lower compartment 511 providing an enclosure for a motor 512 and a blower 513 coupled to the motor. A U-shaped tube 514 is coupled to the air outlet of the blower and is connected to a pipe section 516 having an inverted J-shaped configuration for the same purpose as that described above with respect to the other embodiments. Section 516 extends through a partition 515 separating the compartments and into reservoir 510. A pair of openings 517 provide exhaust conduit means for exhausting air entering the reservoir to the atmosphere. The open inner end of section 516 faces away from openings 517.

Tube 514 has an elongated slit 518 near its lower end to define a liquid inlet end therefor. Thus, section 516 and the portion of tube 514 between opening 518 and section 516 presents an inlet conduit for reservoir 510. The liquid entering the slit passes upwardly by suction through section 516 and into the reservoir. The position of slit 518 relative to the forced air flow in tube 514 is such as to create a partial vacuum in the vicinity of this slit. This suction force is due to a Venturi effect and is selected to assure that liquids sucked up into the tube will be deposited into the reservoir without passing out of openings 517 with the air flow itself.

The embodiment of FIG. 6 is used in essentially the same manner as the embodiments of FIGS. 4 and 5. To facilitate movement of housing 509 over a floor, suitable anti-friction means, such as rollers or the like, can be attached to the housing near opening 518 to thereby facilitate movement of the housing over the floor or other surface. A suitable drain 519 can be provided to permit draining of reservoir 510 when the need arises. Also, a closure can be provided in the same manner as that shown in FIG. 1a for the inner end of section 516 to prevent reverse flow of liquid from reservoir 510 when the reservoir is too full.

FIG. 8 illustrates an improved wand-like conduit for use with a vacuum cleaner and includes a body having a number of interconnected, relatively telescoped, tubular sections 610, 612 and 614 which can be moved relative to each other from the expanded, end-to-end positions shown in FIG. 8 to collapsed positions with sections 612 and 614 within section 610. Section 614 is shown with a gently tapered outer surface so that it can be coupled to different types of accessories, such as hoses and floor-engaging dust pick-up devices. Seal means is provided at the junction of each pair of adjacent tubular sections to prevent fluid leakage at the junction. The outer end of section 610 is tapered for receiving connecting hoses of different diameters. The conduit of FIG. 8 can be used with a conventional vacuum cleaner for increasing the effective length of an extension hose so as to permit cleaning in hard-to-reach areas, such as along beamed ceilings or in recesses of rafters or the like. The sections of the conduit can be made of any suitable material, such as metal, plastic or the like.

FIG. 9 illustrates how the outer end of section 614 can be modified so as to provide an end capable of passing over the top of high surfaces. To this end, section 614 has a pair of relatively angularly disposed portions 616 and 618, the latter having a tapered end 620 for universal attachment to various accessories.

FIG. 9*a* shows a means of connection for the end of a tube 622, wherein a flexible sleeve carried by tube 622 can be moved from the position shown in the figure to a position surrounding the end of a second tube. Thus, the tubes will be interconnected and be in fluid communication with each other. Also, sleeve 624 will provide an effective seal at the junction of the tubes.

The telescoping character of the conduit of FIG. 8 can be used with each of the embodiments of FIGS. 1–3. Thus, to provide a greater distance between the exhaust conduit and the vacuum source of each of these embodiments, a telescoping exhaust conduit can be used, such conduit being collapsed when the apparatus is to be stored.

We claim:

1. Apparatus for use in removing a liquid from a surface comprising: an assembly including a reservoir, an intake conduit, and means defining an exhaust conduit, said intake conduit having an open inlet and exteriorly of the reservoir and an open outlet end in fluid communication with said reservoir, the inlet end being disposed to permit liquid to enter the same by suction and to flow through said intake conduit when a flow of fluid is established therein, whereby liquid flowing through said intake conduit will exit therefrom through said outlet end and will enter the reservoir, said exhaust conduit being disposed to exhaust said fluid from the reservoir and adapted to be coupled to a vacuum source; means on said assembly for adjustably venting said reservoir to the atmosphere to thereby permit variations in the suction force at said inlet end; and a valve carried by said assembly for blocking said exhaust conduit against fluid flow therethrough when the fluid mass flow rate therethrough is above a predtermined volume.

* * * * *